US006286691B1

(12) United States Patent
Oberhaus et al.

(10) Patent No.: US 6,286,691 B1
(45) Date of Patent: Sep. 11, 2001

(54) SHELVING FOR SUSPENSION FROM RAFTERS, OR THE LIKE

(75) Inventors: Fred D. Oberhaus; Michael L. Gusdorf, both of St. Louis, MO (US)

(73) Assignee: Industrial Wire Products, Inc., Sullivan, MO (US)

( * ) Notice: Subject to any disclaimer, the term of this patent is extended or adjusted under 35 U.S.C. 154(b) by 0 days.

(21) Appl. No.: 09/114,397

(22) Filed: Jul. 13, 1998

Related U.S. Application Data

(60) Provisional application No. 60/052,515, filed on Jul. 14, 1997.

(51) Int. Cl.[7] ..... A47F 5/08

(52) U.S. Cl. ..... 211/118; 211/113; 211/90.03; 211/181.1

(58) Field of Search ..... 211/118, 119, 211/181.1, 90.03, 113, 86.01; 108/42, 106, 107, 144; 182/150

(56) References Cited

U.S. PATENT DOCUMENTS

D. 270,977 * 10/1983 Kneale, III ..... D6/113
2,070,334 * 2/1937 Garber ..... 240/3
2,850,172 * 9/1958 Beckner ..... 108/107 X
2,969,154 * 1/1961 Pelletier ..... 211/119 X
3,265,246 * 8/1966 Messenger ..... 211/119 X
3,391,891 * 7/1968 Garden ..... 211/181.1 X
4,061,092 * 12/1977 Jacobsen et al. ..... 108/149
4,157,070 * 6/1979 Huempfner ..... 108/107 X
4,388,982 * 6/1983 Yonahara ..... 182/82
4,712,692 * 12/1987 Peinsipp ..... 211/119
4,732,235 * 3/1988 Reed ..... 182/142
4,732,284 * 3/1988 Remmers ..... 211/181.1 X
4,815,563 * 3/1989 Puccinelli et al. ..... 182/150
4,893,715 * 1/1990 Papazian et al. ..... 211/119 X
5,100,008 * 3/1992 O'Herron ..... 211/119 X
5,221,014 * 6/1993 Welch et al. ..... 211/181.1 X
5,460,279 * 10/1995 Emery et al. ..... 211/119 X
5,542,530 * 8/1996 Freelander ..... 108/106 X
5,749,479 * 5/1998 Belokin et al. ..... 211/113
5,788,093 * 8/1998 Krut ..... 211/90.03 X
6,098,751 * 8/2000 Eichenlaub et al. ..... 182/150

* cited by examiner

*Primary Examiner*—Daniel P. Stodola
*Assistant Examiner*—Khoa Tran
(74) *Attorney, Agent, or Firm*—Paul M. Denk

(57) ABSTRACT

A metallic or hard plastic storage shelf including four vertical rods provided at each corner of one or more shelves, with the upper ends of the vertical rods including fasteners for direct securement of the storage rack to a pair of routinely spaced apart rafters, as located within a garage, attic, manufacturing plant, machine shop, or the like.

8 Claims, 3 Drawing Sheets

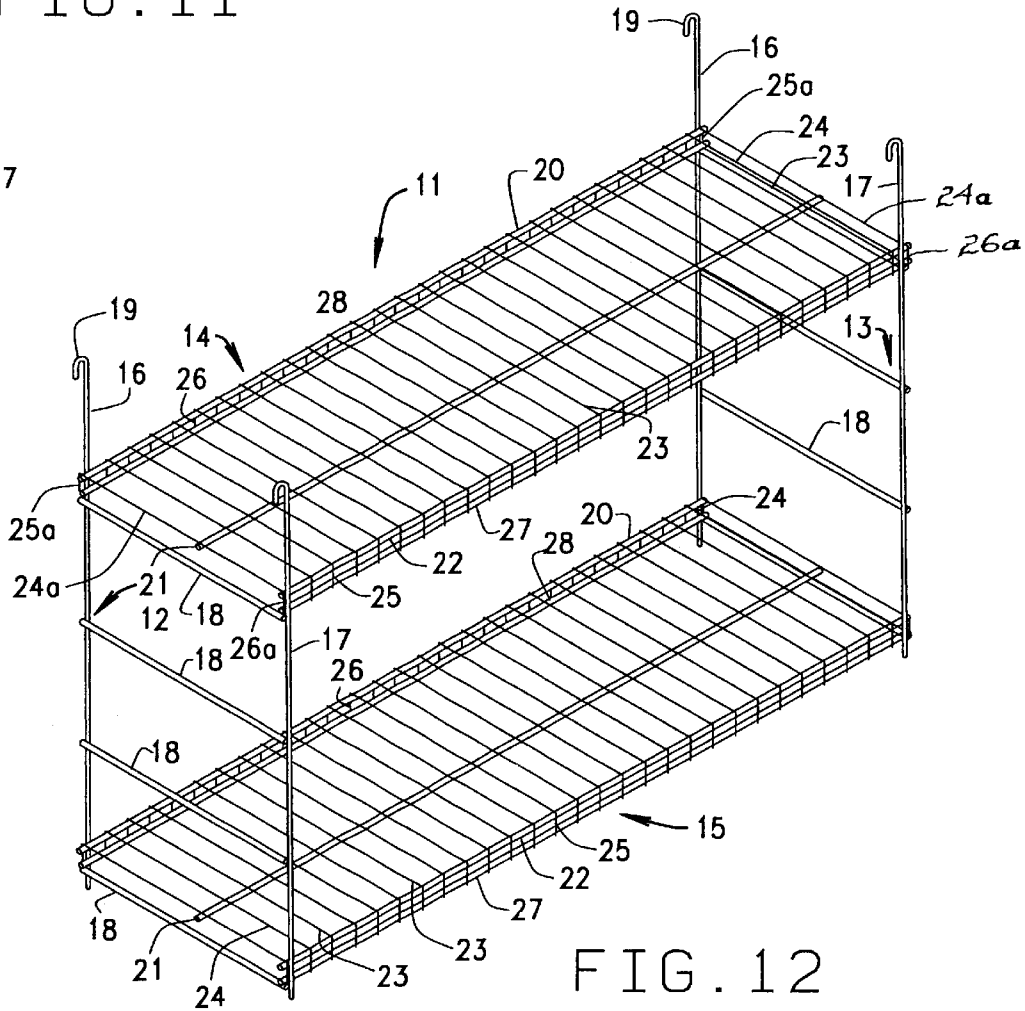
FIG. 11
FIG. 12
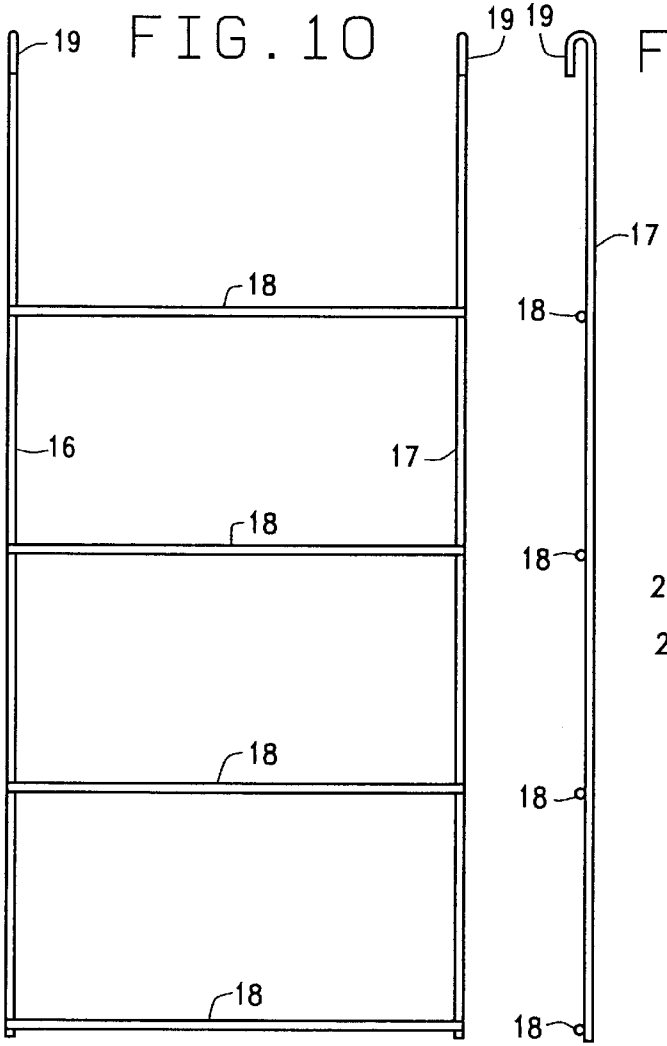
FIG. 10

SHELVING FOR SUSPENSION FROM RAFTERS, OR THE LIKE

This application claims benefit of Provisional Application Ser. No. 60/052,515 filed Jul. 14, 1997.

BACKGROUND OF THE INVENTION

Numerous types of racks are available in the prior art, for use for storing goods of various types. Most of these types of racks are generally supported upon the floor, may dispose a plurality of integral shelving, for use for storing almost anything, including tools, hardware, lumber, and the like. In addition, there are numerous publications and embodiments for shelving that may be appended directly to the wall, wherein a support means adheres directly to the wall, by means of some type of fastening, and then hooks a series of cantilevered shelves off of the support means, to readily dispose a plurality of shelving for storage and suspension of any variety of goods.

As is also well known in the art, and particularly when storage is designed for location within a garage, or an attic, frequently platforms are provided upon the roof rafters, whether it be sheets of plywood, or the like, also for storage of goods and other items thereon. And, in certain instances, it is possible that wooden supports may be suspended from the rafters, with cross-bracing provided at their lower end, in order to form a cradle-like member for disposition and storage of lumber, or other items.

It is, therefore, the improvement of the current invention to provide a uniquely designed prefabricated rack, generally constructed of metallic materials, and which disposes one or more integral shelves therein, for suspension and storage of various items thereon.

SUMMARY OF THE INVENTION

This invention relates generally to storage racks and shelving, and more particularly to one or more shelves integrated into a suspension rack that may be suspended and hanged dependedly downwardly from the rafters of a building, garage, attic, or the like.

This invention contemplates the formation of a suspension type of rack, that includes one or more shelving, usually fabricated from metal wire, and which is integrated together by means of fasteners, or welded into a unified structure, wherein the series of shelves connect integrally with four vertically extending rods at the corners, and which four rods are spacedly arrange at a dimension that provides for their ready attachment to a series of rafters, or at least a pair of rafters, which generally are spaced apart, on center, approximately 16 inches in dimension. The storage rack of this invention, in the preferred embodiment, may include approximately five integrated shelving, which connect to the four vertically extending rods, and are located at a sufficient distance downwardly from the upper end of the rods, to provide for ready storage of various items, at a convenient reach to the user, when the storage rack is suspended from various rafters, and provides for ready access to its shelving, during usage and application.

The upper end of the vertical rods may include various types of fastener means, to conveniently allow for the attachment of the storage rack to the rafters, and in the preferred embodiment, these fasteners undertake the structural shape of hooks, that may conveniently cooperate with eyelets, that will have been previously fastened into the rafters, either along their sides, or their under surface, thereby allowing the storage rack of this invention to be readily suspended, for prompt usage, after its installation. Other types of fastener means may also work just as conveniently, such as threaded or welded sleeves, having one or more apertures provided therein, arranged at the upper ends of the vertical rods, and through which fasteners, such as nails, may be inserted, for attachment to rafters of the storage rack of this invention thereto, during its installation.

The various shelving integrated into the storage rack of this invention may have both lengthwise and widthwise integrated wires, in order to provide for convenient storage of items thereon, and which wires are arranged in sufficient numbers, generally parallel arranged, form platforms, in order to not only support any items stored thereon, but also to furnish structural strength to the shelving, and the assembled storage rack, when installed. Obviously, since in the preferred embodiment approximately five shelves may be included, or even more if desired, the weight of all of the items stored thereon can be substantial, when accumulated, and thus, the shelving needs to be reinforced, through the use of well-designed wires, to afford the structural support necessary to accommodate the storage of multiple items, of accumulated heavier weight, thereon, during usage.

A further embodiment of this invention is to utilize a pair of ladder-like structured end frames, which at the upper ends may include securement means for fastening to the rafters of a building, garage, or the like, with the suspended end frames having a series of rigidly secured lateral braces, and upon which shelving may be inserted and suspended, to provide for singular or multiple shelving supported by this development, and for use for storage purposes. The shelving itself will provide a length of shelving having a dimension either approximately 16", 32", 48", etc., along 16" inch increments, or slightly longer thereof, so that when the shelving is inserted and rested upon the lateral braces, of each end frame, the shelving will be fully supported at each end by said frames. In addition, the shelving may include at their outer ends an additional support rod, or any other form or protrusion, so as to assure that once a shelf has been located in place, suspended by the end frames, the shelf will not slide out of the end frame, since its protrusion or support rod will embrace the outer edge of the end frame, to prevent the shelf from sliding free. In addition, each shelf is fabricated having down turned front and back edges, which in the preferred embodiment, may be bent slightly in excess of 90°, so that the upper edges of the shelf, where the downturned portion integrally form with the rods forming the shelf surface, it is that juncture which biases tightly within the end frames, to provide for a snug and secure locating of each shelf when emplaced within its pair of end frames, when assembled into the fabricated shelving of this invention.

It is, therefore, a principal object of this invention to provide shelving, supported by end frames, and which may be suspended from rafters, or other precisely spaced apart beams, to furnish instant storage for items within a garage, building, or other structure.

Another object of this invention is to provide the fabrication of a supporting shelf that may be suspended from beams, and which may be integrally or rigidly formed.

Another object of this invention is to provide a supporting shelf which may be suspended from rafters, or the like, and which may be fabricated from components, and assembled at the sight of installation, simply through the suspension of a pair of end frames from said beams, and then snugly locating one or more shelves within the end frames for their suspension into a storage position.

Another object of this invention is to provide portable type shelving that may be instantly and faciley installed within any space where exposed rafters or beams are readily available to accept fasteners such as eyelets, bolts, or the like.

A further object of this invention is to provide supporting shelving that may be assembled and installed at the site of storage, and which may be made to incremental lengths, usually on 16" centers, to any length desired by the user.

Other objects may become more apparent to those skilled in the art upon reviewing the description of the preferred embodiment herein.

Other various components may be used in the structure of this storage rack, within the scope of the invention as defined herein, upon review of this summary of the invention, when further considered with the description of its preferred embodiment, in light of the drawing accompanying this application.

BRIEF DESCRIPTION OF THE DRAWINGS

In referring to the drawings,

FIG. 10 is an end view of an end frame;

FIG. 11 is a side view of an end frame; and

FIG. 12 discloses a fully assembled shelving, ready for suspension from rafters, beams, or the like, and showing two shelves installed within a pair of end frames.

DESCRIPTION OF THE PREFERRED EMBODIMENT

Figure 1:
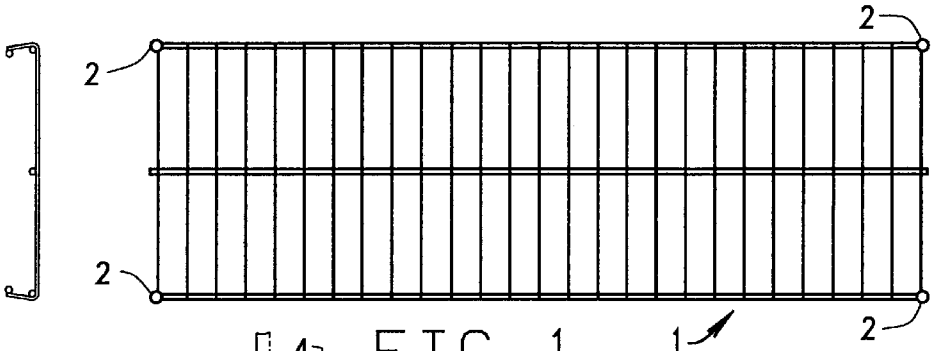
FIG. 1 provides a plan view of the storage rack of this invention.
Figure 2:
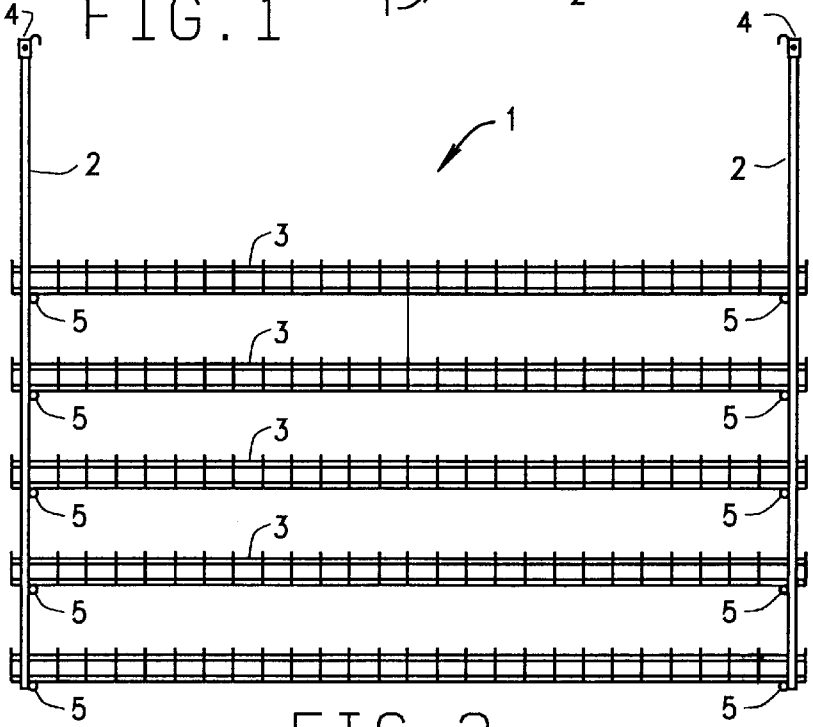
FIG. 2 is a side view thereof.

In referring to the drawings, and in particular FIGS. 1 and 2, there is shown the storage rack 1 of this invention. As disclosed and shown, the rack includes four vertically disposed rods, as at 2, which locate at the corners of the shown rack, and which have secured integrally thereto, as by fasteners, but preferably by welding, a series of shelves 3, as can be noted. While FIG. 2 discloses a series of five shelves, as at 3, it is just as likely that more or less of such shelves may be used within the fabricated rack, and which may dispose shelving up to the proximity of its upper fastening means 4, when it is desired to provide as much storage as possible, from the storage rack, of this design. When the rack is being used to store smaller individual items, then more shelvings may be included. On the other hand, where the rack may be desired for supporting, in storage, materials such as lumber, then perhaps only a single bottom rack, as at 3*a*, may be used, so that lumber can be stacked thereupon, and extend up between the vertical rods 2, storing an abundance of lumber thereon, as can be understood. In order to provide convenient means for securement of the shelving 3 and 3*a* to their vertical corner rods 2, cross-braces 5 may span the space between two of the end located vertical rods 2, before the shelving is welded in place, in order to add further support, and to predimension the spacing of the vertical rods apart, during their installation. Obviously, the components of the rack may be fabricated of metal, and vinyl coated for adding to its endurance and appearance.

For example, since this particular storage rack is designed for use in conjunction with rafters, whether it be roof rafters, rafters providing support for the ceiling of a garage, or even within a machine shop, or manufacturing plant, normally such rafters are spaced apart approximately 16 inches center-to-center. Thus, each pair of vertical rods 2 located at an end of the storage rack of this invention will likewise be located exactly 16 inches apart, so as to conveniently dispose their upper ends, and their fastening means 4 and 7, at the precise distance needed to furnish securement of the end rods directly to adjacent rafters, that, as previously explained, are usually routinely spaced apart, usually by code requirements, at 16 inches on center. On the other hand, the end rods may be spaced apart 16", 32", 48", on 16" increments, as desired and required. The cross-bracing 5 may be fabricated from wire rods, or they may be channel shaped, and even have slight incline to their sides, in order to add further structural strength to their design, and to enhance the support for their connected shelves, to allow the disposition of many more items, materials, hardware, tools, and the like, for storage.

Figure 5:
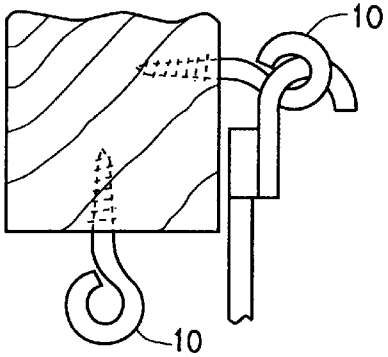
FIG. 5 shows an alternate fastener means for securement of the storage rack to a rafter, disclosing the hook style of fastener means as shown in FIG. 2, being suspended to the side of its shown associated rafter.
Figure 6:
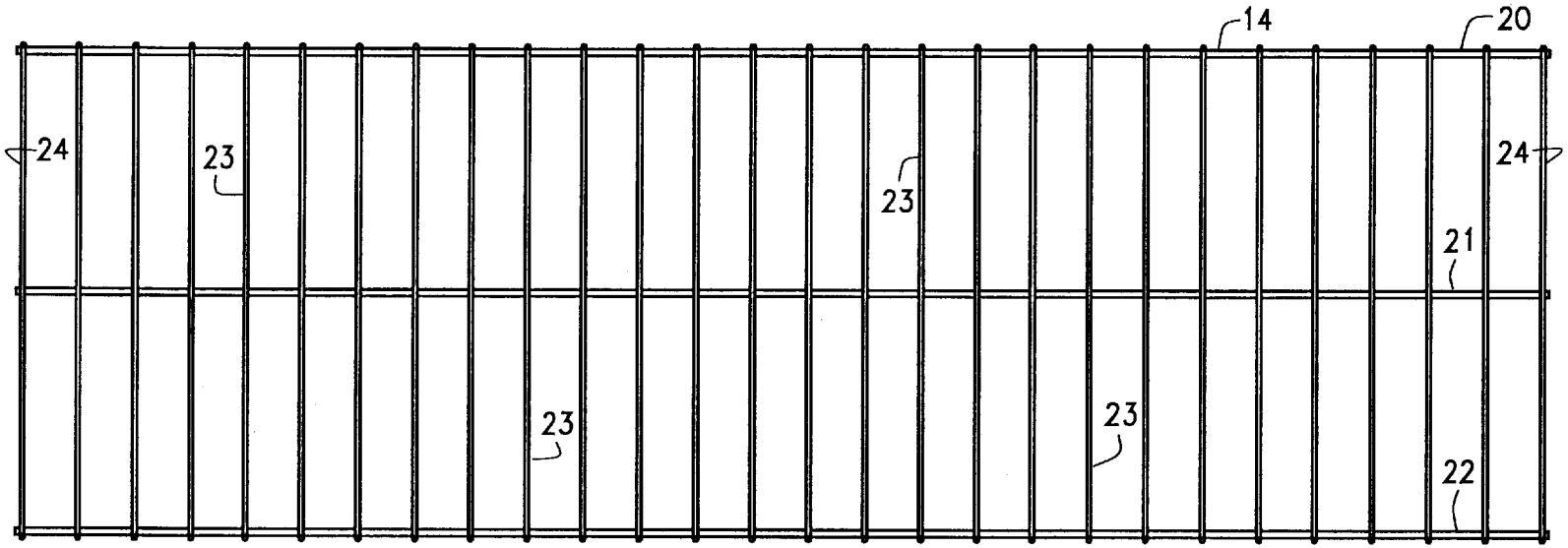
FIG. 6 is a plan view of an incremental length of shelving.

As can be seen in FIG. 2, the upper fastening means 4 provided at the upper end of each vertical rod 2, in this particular embodiment, is designed as hook means, as noted, that are secured, as by threading, or welded, to the upper ends of said rods. Thus, as can be seen in FIG. 5, the installer will apply an eyelet, as at 6, either to the bottom of the rafter, as noted, or to its side, and conveniently dispose the eyelet for having the hooked upper end of the storage rack secured therein, for ready usage.

Figure 3:
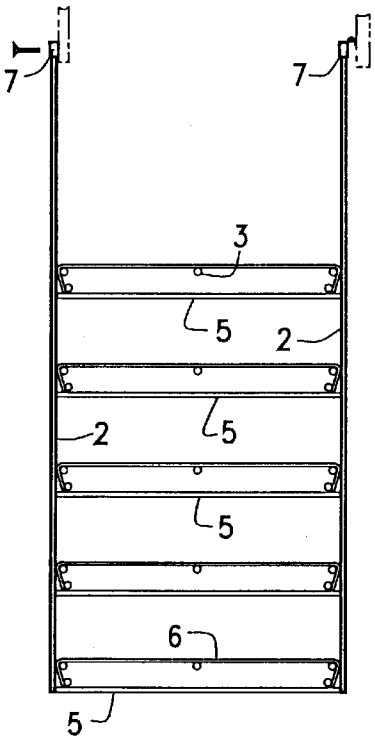
FIG. 3 is an end view thereof, showing the storage rack appended, by means of nails, to a pair of standard spaced apart rafters.
Figure 4:
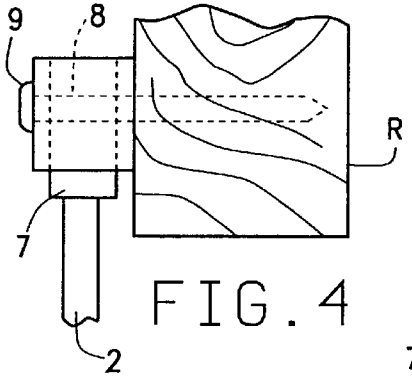
FIG. 4 is a partial view showing the bottom of a rafter, with the style of fastener means, as shown in FIG. 3, securing the upper end of the rack's vertical rods to the disclosed rafter.

In the alternative, as can be seen in FIG. 3, the upper ends of the vertical rod 2 may have threaded or welded thereto a sleeve-like member, as at 7, and which sleeves may have apertures, as at 8, provided therethrough, to conveniently dispose their apertures for reception of a fastener means, such as a nail or screw, as shown at 9, for ready application of the storage rack to the adjacent rafter R, as noted. As can be seen, these fastener means 9 may be either welded directly to the top of the vertical rods 2, at each corner of the storage rack, or it may be threadedly engaged thereon, by means of threads (not shown) applied to the top of the rod 2, and which may be receptive within a threaded bore furnished at the bottom of the fastener means 9, as can be understood.

In any event, the width of the storage rack generally will be approximately 16 inches between the center of the vertical end rods 2, or if greater width is desired, then the rods, at an end of each rack may be disposed apart at increments of 16 inches, such as at 32", 48", and the like, so that the upper ends of each vertical rod will be readily disposed for connection to the side or bottom of an associated rafter, when installed, as previously explained. Likewise, the length of the storage rack should also be at 16 inch increments, so that the length, as shown in FIG. 2, may be either 32", 48", 64", etc., so as to conveniently dispose their upper ends, lengthwise, once again aligned with either the sides or bottom of a pair of spaced apart roof rafters, to provide for the convenient attachment of the upper ends of the shown storage rack, directly to routinely spaced rafters, when installed.

In referring to FIG. 12, the modified form of shelving 11 is disclosed. As can be seen, there are a pair of end frames 12 and 13 provided at each end of the shelving, and supporting shelves 14 and 15 installed therein, in preparation for their suspension from rafters, beams, or the like, to provide for instant storage. Each end frame, as shown in FIGS. 10 and 11, includes a pair of vertical support rods 16 and 17, and which has secured or otherwise welded thereto a series of lateral or transverse support rods 18. As many rods 18 may be included, as shelving that may rest thereon as may be desired, dependent upon the spacing that may be provided there between. For example, the shelving may be suspended from a rafter, and have support rods 16 and 17 that extend all the way to the floor, for the variety of transverse support rods 18 furnished therebetween, to dictate the amount of shelving desired. On the other hand, the only limitation is the amount of supporting strength desired from the shelving, and the type of material to be stored thereon. If it is of lightweight, then obviously, more shelving may be included.

As can be seen in FIG. 11, the upper end of each support rod 16 and 17 may include a fastening means, such as shown at 19, and in this particular instance, once again, comprises a hook, useful for suspending within an eyelet, as previously explained, in FIG. 5, that may have been previously embedded or otherwise secured within a rafter or beam.

Figure 9:
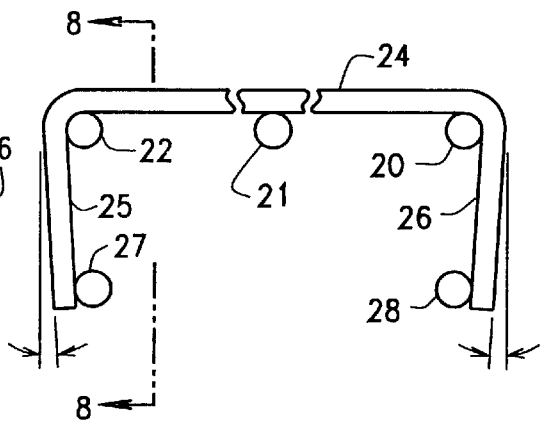
FIG. 9 is an end view of a supporting shelf showing how the down turned front and back edges of the shelf are bent slightly inwardly from the vertical, to facilitate their installation and provide for snug retention within their end frames when assembled.
Figure 7:
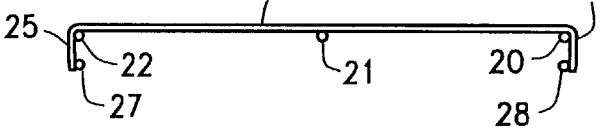
FIG. 7 is an end view of the shelving of FIG. 6.
Figure 8:
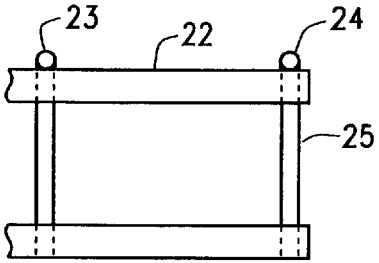
FIG. 8 is a sectional view of a shelving, showing how support rods extend and are secured to the length rods of the shelving, and having a rod proximate the end of the shelving to provide securement and suspension within their installed end frame, as taken along the line 8—8 of FIG. 9.

FIGS. 6 through 9 disclose the type of shelving fabricated for use in conjunction with the end frames, as previously described. The shelving 14 and 15 include a series of longitudinal rods, as at 20 through 22, and which has a series of shelf forming rods 23 soldered, welded, or otherwise secured to the longitudinal rods. The end shelf forming rods 24 are also secured to the longitudinal rods, and are designed not only to provide rigidity to the ends of the formed shelf, but also to provide a form of stop means that retains the shelving within their supporting end frames, once installed. The projection of the end rods 24 protruding from the longitudinal rods 22 can be more readily seen in FIG. 8, since, the shelf forming rods 23 and 24 are arranged exteriorly of the longitudinal rods, during fabrication of a shelf. As can also be seen in FIGS. 7 through 9, the shelf forming 23 and 24 are bent downwardly, as at 25 and 26, and are bent slightly beyond a vertical or 90° angle, as can be seen in FIG. 9, and for the following purpose. It is also to be noted that lower longitudinal rods 27 and 28 are provided at the downward bent ends of the support rods, in order to provide structural rigidity at said location.

The reason for the slight bend further or beyond the vertical of the down turned support rods 25 and 26, as can be seen in FIG. 9, is due to the fact that the shelving, in its full width, is equivalent to the space between the end frame vertical support rods 16 and 17. Hence, when a shelving is installed within an end frame, there is a slight bind as the shelf is inserted therein. Initially, one side of the shelving will be installed at a juncture between the vertical support rod 16 and one of its affixed transverse support rods 18, and the shelf will be tilted, during its installation, and at such time, the other side of the shelf will then be forced downwardly, into a horizontal position, into the juncture between the opposite support rod 17, and the corresponding transverse rod 18, and under a biasing force pressured into its usable configuration, as shown in FIG. 12. Hence, once a shelf is installed, within its end frame, it will be snugly and pressure fitted therein, to add to the stability of the assembled shelving, for ready usage. And, due to the pressure fit of a shelf within its respective end frames, the shelving, once assembled, is fully integrated, and does not rattle or cannot be shaken loose, during usage, due to this pressure fit type of engagement of its various components when the shelving is assembled for installation. This downturn of the return or edges of the shelf acts to strengthen the shelf and give it increased rigidity, when installed. This allows the shelf to be formed of maximum width, within the inside dimension of the end frame formed ladders, to provide for more stable assembly, and support of stored items, when the shelving is installed. In addition, this downturn feature of the shelving creates a locking situation between the last wire, as previously explained at 24, and the end frame, since those last wires 24 will be located outside of the end frame, when a shelving is installed, so as to keep the shelving from slipping free, or from swaying during usage, and will not allow the shelf to slide out from between the end frames, once assembled and installed. Furthermore, any other type of protrusion could be utilized at the location of the end shelf rods 24, so as to assure that a shelf remains intact within its end frames, once slid into assembly.

A critical feature of this invention, and its concept, is the fact that it creates an end frame or ladder effect that can be located at dimensions apart of approximately 16". This is most critical in allowing for the use of this shelving, and the installation of its end frames, in a vertical or spaced apart manner, with respect to the number of rafters that are intended to be used for support for the shelving of this invention. By making the end frames, and more particularly their vertical rods 16 and 17 exactly 16" wide, gives the purchaser total versatility as to how the product is to be used, when supported between rafters, regardless of which direction the rafters are oriented within the building, into which the shelving is to be installed. Locating these end frame vertical rods 16 and 17 at any other dimension would not allow for this versatility. On the other hand, if the consumer is installing this shelving along the length of the rafters, or parallel underneath of the rafters, then the 16" dimension, along the length of the shelving, may not be that critical.

Variations or modifications to the subject matter of this invention may occur to those skilled in the art upon reviewing the summary and description of the invention provided herein. Such variations or modifications, if within the spirit of this invention, are intended to be encompassed within the scope of the principle of this development as explained herein. The description and disclosure of the preferred embodiment provided herein is done so for illustrative purposes only.

Having thus described the invention, what is claimed and desired to be secured by Letters Patent is:

1. A storage rack for use for suspension from rafters or beams, as provided in a building, garage, or related structure, comprising said storage rack having a pair of end frames, each end frame formed of a series of vertical rods, one of each vertical rod located at each corner of the storage rack, thereby providing a pair of vertical rods at each end of the storage rack, a series of cross braces provided between each pair of vertical rods, in each end frame of the storage rack, the upper end of each vertical rod having a fastener located thereat, for securement of the storage rack to the adjacent building rafters or beams, to which the storage rack secures and suspends, a series of integrally structured shelves, one of each shelf supported upon a cross brace and horizontally extending across the storage rack for support upon the aligned cross brace at the opposite end of said storage rack, each shelf including a series of longitudinal rods, a series of support rods secured to and extending between each of the longitudinal rods, to provide a shelf-like structure thereupon, and each formed shelf disposed for resting upon a pair of spaced cross braces when installed in the end frames for the storage rack, for support of items thereon, said support rods bent downwardly at their ends to form depending portions laterally of the shelves, to add structural reinforcement to the shelves during usage, said support rods located at each end of the longitudinal rods of the formed shelves providing for an engagement with the vertical rods of the end frames for the storage rack to prevent the shelves from sliding free from the end frames once installed, and each shelf having a pressure fit with the vertical rods when a shelf is positioned upon the cross braces and between the vertical rods of the pair of end frames.

2. The storage rack of claim 1 and including further longitudinal rods connecting to the lower edges of the bent down portions of the support rods to add structural reinforcement to the shelves during installation.

3. The storage rack of claim 2 wherein said bent down portions of the support rods are arranged at an angle of less than 90° with the horizontally disposed portions of the support rods that form the shelf surface, thereby to facilitate the insertion of the shelves between the vertical rods of the end frames upon installation.

4. The storage rack of claim 3 wherein the fastener for securing the storage rack to a rafter or beam includes formed hooks for securement of the upper ends of the vertical rods to a rafter.

5. The storage rack of claim 4 wherein each formed hooks include a sleeve, said sleeve having a hooked portion extending therefrom, and said sleeve provided for securement to the upper end of the vertical rod during installation.

6. The storage rack of claim 3 wherein the fastener for securing the storage rack to a rafter or beam includes a hook fastener.

7. The storage rack of claim 1 wherein said end frames, and series of integrally structured shelves, are fabricated of metal.

8. The storage rack of claim 7 wherein said metal end frames and shelves are vinyl coated.

* * * * *